United States Patent [19]

Bendler et al.

[11] 4,014,264

[45] Mar. 29, 1977

[54] COMBINED IGNITER CAP

[75] Inventors: Hellmut Bendler, Nurnberg; Heinz Gawlick, Furth, Bayern, both of Germany

[73] Assignee: Dynamit Nobel Aktiengesellschaft, Germany

[22] Filed: Aug. 21, 1975

[21] Appl. No.: 606,448

[30] Foreign Application Priority Data

Sept. 13, 1974 Germany ..... 2443793

[52] U.S. Cl. ..... 102/46

[51] Int. Cl.[2] ..... F42C 19/10; F42C 19/12

[58] Field of Search ..... 102/46, 70.2 A

[56] References Cited

UNITED STATES PATENTS

| | | | |
|---|---|---|---|
| 712,826 | 11/1902 | Mason | 102/46 |
| 3,363,565 | 1/1968 | Walther | 102/46 |
| 3,6,11,939 | 10/1971 | Stadler et al. | 102/46 |
| 3,719,148 | 3/1973 | Gawlick et al. | 102/46 |
| 3,867,885 | 2/1975 | Gawlick et al. | 102/46 |

*Primary Examiner*—Charles T. Jordan
*Attorney, Agent, or Firm*—Craig & Antonelli

[57] ABSTRACT

A combined igniter cap for electrical and nonelectrical ignition having an electrically conductive housing with a pole piece arranged therein. A first primer charge is arranged on a first side of the pole piece, and the pole piece being provided with a recess and a first communicating path through the pole piece between the recess and the first primer charge. A second ignition system is arranged in the recess and is ignitable from a second side of said pole piece which is disposed oppositely to the first side. An insulating element is disposed between the first side of said pole piece and the first primer charge and is provided with first and second electrical contact members having an electrical ignition bridge and/or gap formed therebetween. The electrical ignition bridge and/or gap faces the first primer charge and the first contact member is electrically conductively connected with the pole piece while the second contact member is electrically conductively connected with the housing. The insulating element is further provided with a second communicating path providing communication between the first communicating path and the first primer charge.

25 Claims, 5 Drawing Figures

Figure 3:
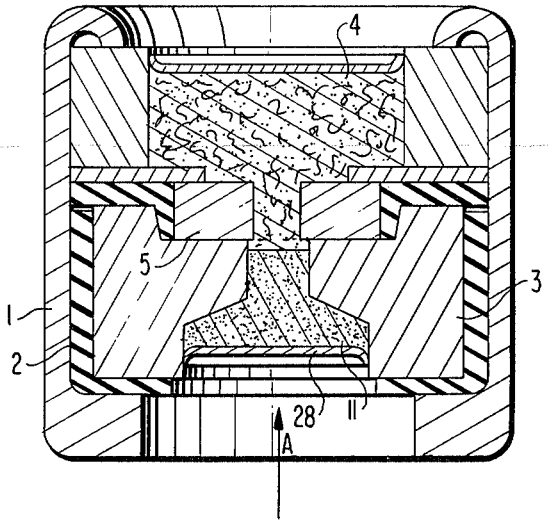

FIG. 1
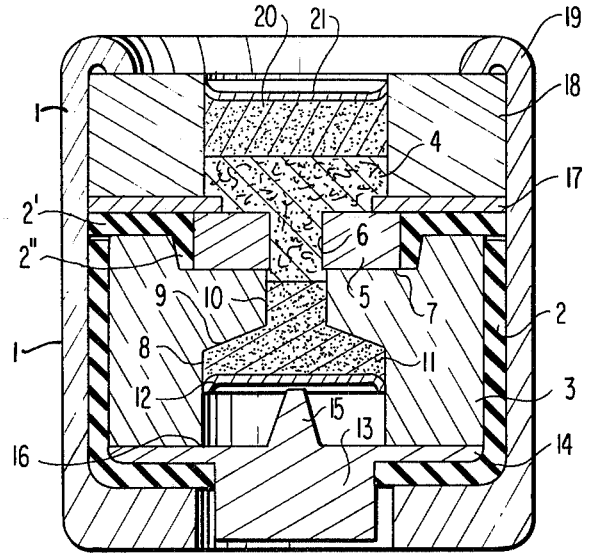
FIG. 2a
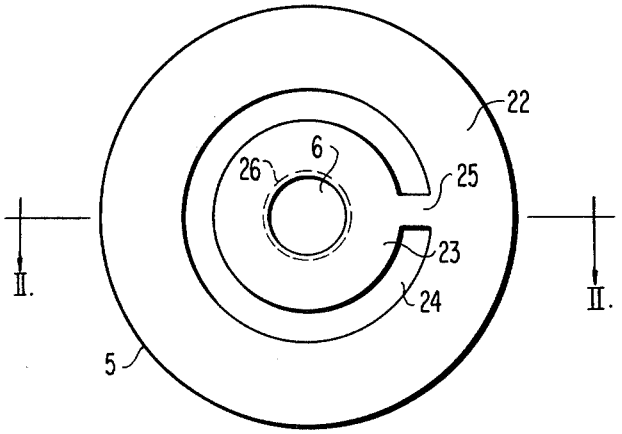
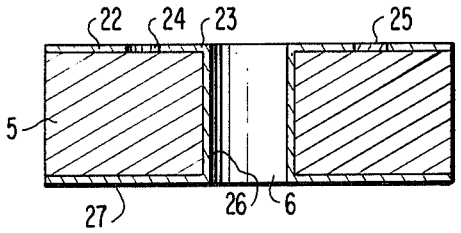
FIG. 2b

COMBINED IGNITER CAP

The present invention relates to combined igniter caps.

Combined igniter caps for electric and, for example, nonelectrical such as mechanical initiation of devices can be utilized, for example, in detonators for projectiles or igniters for propellant charges. They effect the mechanical initiation, for example, when the projectile impinges on the target, whereas when the target has been missed, the combined igniter cap effects an electrical triggering after a predetermined time interval has passed from the instant of firing for destruction of the projectile. When used in propellant charge igniters, the appropriate ammunition can be fired from different weapons, i.e. those with electrical or mechanical initiation.

Such a combined igniter cap has been disclosed, for example, in British Pat. No. 965,413. This cap has a pole piece separated from the external housing by an electric insulation. An impact- or percussion-sensitive primer charge is arranged, for example, in a recess of the pole piece, this charge being prevented from falling out by a capsule-shaped housing sealing off the pole piece recess toward the rear. The pole piece recess is connected by way of two bores with the primer charge, which latter is in contact with the pole piece. The charge is electrically conductive and makes it possible to bridge electrically the gap defined by the insulation between the housing and the pole piece. In this combined igniter cap, the primer charge to be ignited mechanically and the igniter charge to be ignited electrically are advantageously separated from each other, so that the respective ignition requirements can be satisfied to an optimum extent. Also, this igniter cap has a relatively compact size. However, there is the disadvantage that the electric leakages in the electric initiating system are undesirably great due to the fluctuations of the gap dimensions between the housing and the pole piece, unavoidable in a mass-produced article and caused by the interposed insulation. Consequently, uniform ignition conditions cannot be ensured.

It is therefore an object of the present invention to provide a combined igniter cap which overcomes the disadvantages of the prior art combined igniter caps.

The present invention is based on the problem of fashioning a combined igniter cap with a maximally small, compact construction so that the electric leakages therein are maintained within maximally narrow limits or tolerances; the cap has maximally high impact resistance, and yet the cap is maximally simple in manufacture and in its installation in the projectile fuse, propellant igniter, or the like. The high impact resistance is required in view of weapons having a very high firing speed wherein, during the loading operation, short-term accelerations can occur of about 100,000 g.'s (g. = acceleration of gravity) and thereabove.

In accordance with the present invention, the aforementioned problem is solved by providing a combined igniter cap having an electrically conductive housing with a pole piece arranged therein. A first primer charge is arranged on a first side of the pole piece and the pole piece is provided with a recess and at least a fist communicating path between the recess and the first primer charge. The communicating path may be formed by at least one bore extending in the axial direction of the pole piece. A second ignition system is arranged in the recess of the pole piece and is ignitable from a second side of the pole piece which is disposed oppositely to the first side. An electrically insulating element having first and second electrical contacts and a defined ignition gap or bridge formed therebetween is disposed between the pole piece and the first primer charge with the ignition gap or bridge facing the first primer charge. The first contact is electrically conductively connected with the pole piece and the second contact is electrically conductively connected with the housing. The insulating element is further provided with at least a second communicating path for providing communication between the 7 first communicating path and the first primer charge. The second communicating path may be formed by at least one aperture extending in the axial direction through the insulating element and being at least partially congruent with the bore of the pole piece.

The electric contacts with the ignition bridge and/or the ignition gap can be applied even in case of a mass production with high accuracy to the insulating element produced, for example, from a laminated material made up of a synthetic resin with a fiber insert, of glass, or of a ceramic material. This can be accomplished, for example, in accordance with DOS (German Unexamined Laid-Open Application) No. 1,771,889 following the methods for the production of printed electric circuits, or in accordance with DAS (German Published Application) No. 2,020,016 by vaporization, printing, or by chemical methods. Thus, the electric resistance between the two contacts can be adjusted very accurately and, correspondingly, the leakages in the ignition characteristic can be kept at a small value. The at least one continuous aperture of the insulating element is advantageously associated with the at least one bore of the pole piece so that upon an initiation of the second ignition system the ignition jet emanating from the primer charge thereof can flawlessly ignite the primer charge of the electric igniter cap disposed in the recess of the insulating element and/or on the side of the latter facing away from the pole piece.

The combined igniter cap of the present invention is compact in structure, has a small structural size, and is accordingly insensitive to outside influences. Furthermore, the igniter cap can be manufactured in a relatively simple manner and can be installed without difficulties and additional work, such as, for example, without any special external electrical insulation, in projectile detonators, propellant charge igniters, or the like. If, in an individual case, a further increase in impact resistance is required, the provision can suitably be made according to DOS No. 2,245,308 to insert the insulating element in a cup-shaped depression of the pole piece, so that the element can rest with its bottom as well as with its peripheral surface on the pole piece.

To enhance the transmission of the ignition impulse from the second ignition system to the electric igniter cap and thus to be able to reduce the required amount of primer charge for the second ignition system with otherwise identical conditions, a suitable further development of the present invention provides for a single central bore in the pole piece and the recess of the pole piece and the aperture of the insulating element being coaxially arranged therewith. Further, the recess of the pole piece is connected with the bore by a conical construction or inlet. Due to the arrangement of only a single central bore, the ignition jet of the second ignition system is concentrated, which is still further promoted by the conical inlet end of the bore.

The second ignition system can be fashioned, for example, as a flame-sensitive igniter cap pressed into the recess of the pole piece, for example by means of a press-fit, and the housing of this cap, electrically conductively connected with the pole piece, is preferably connectable with the voltage source in case of the electrical ignition. The structure of the flame-sensitive igniter cap is described, for example, in German Pat. No. 1,646,350. This makes it possible, for example, to initiate the combined igniter cap by means of the ignition flame emanating from a pyrotechnical delay line connected in front thereof.

If a mechanical initiation with relatively minor impact energy is required, it is possible according to another feature of the present invention to fashion the second ignition system as a friction or percussion primer. The friction-sensitive primer charge is preferably pressed directly into the pole piece. The conical inlet end of the bore of the pole piece makes it possible advantageously to support the primer charge and thereby provides a further enhancement of the impact resistance without having an adverse effect on the reaction of this primer charge and the discharge of the ignition gases and/or primer charge particles, as can be the case, for example, with a perpendicular shoulder between the bore and the recess of the pole piece. In some applications, a combined igniter cap proves to be advantageous wherein the striker pin or the striker element is initially incorporated into the percussion primer cap. For this purpose, in accordance with another feature of the invention, the striker element is electrically conductive and has a holding element, for example in the form of an annular collar which can be sheared off and with the holding element being electrically conductively connected with the pole piece. This arrangement simultaneously makes it possible, by means of the striker element, in a simple and safe fashion to establish the electric contact between the pole piece, installed in the housing in a relatively hard-to-reach manner, and the external electrical voltage source. If the holding element is fashioned as an annular collar, a simple sealing off of the igniter cap toward the outside is furthermore accomplished.

According to a further feature of the present invention, a particularly simple, reliable, and tight positive connection between the holding element and the pole piece is made possible by a construction of the igniter cap wherein the pole piece is insulated from the housing by insulation and the holding element is clamped between the pole piece and its insulation resting on the housing.

Insofar as a lower sensitivity of the combined igniter cap is desirable or necessary, it is possible according to another feature of the invention to fashion the second ignition system as an impact or percussion-sensitive primer cap with a cup-shaped housing and an anvil provided therein, wherein the anvil rests in the recess of the pole piece. Such an impact-sensitive anvil primer, although generally requiring a greater impact energy for its initiation than a striker-activated primer, is in turn safer during its handling, transportation, etc.

Figure 4:
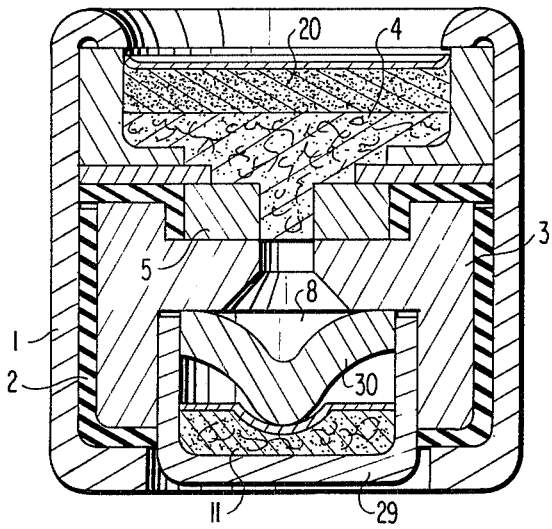

These and further objects, features and advantages of the present invention will become more obvious from the following description when taken in connection with the accompanying drawings which show, for purposes of illustration only, several embodiments in accordance with the present invention and wherein:

FIG. 1 is a longitudinal sectional view of a combined igniter cap which can be initiated electrically and by a striker element in accordance with the present invention;

FIGS. 2*a* and 2*b* illustrate the insulating element of the combined igniter cap in a top view and in a sectional view, respectively;

FIG. 3 is a longitudinal sectional view of another embodiment of a combined igniter cap in accordance with the present invention; and FIG. 4 is a longitudinal sectional view of a further embodiment of a combined igniter cap which can be initiated electrically and by impact.

Referring now to the drawings wherein like reference numerals are utilized to designate like parts throughout the several views, there is shown in FIG. 1, a combined igniter cap including an external housing 1 made of an electrically conductive material, preferably brass, wherein an electrically conductive pole piece 3 is arranged which is likewise made of brass with a view toward strength, on the one hand, and conductivity, on the other hand. This pole piece is separated by electric insulation 2, 2′ of, for example, PVC, polyethylene, or polypropylene. Between the pole piece 3, fashioned as a body of revolution, and a primer charge 4, an insulating element 5 is provided and having a continuous central axial aperture 6 and electric contacts, not shown. The insulating element rests within a cup-shaped depression 7 of the pole piece 3 with its bottom surface directly on the pole piece 3 and with its peripheral surface indirectly on the pole piece 3 by way of a conical, collar-like extension 2″ of the insulation 2′. The pole piece 3 is further provided with a recess 8 on its side facing away from the primer charge 4, which recess is in communication via a conical constriction 9 and a central bore 10 with the aperture 6 of the insulating element 5. A striker- or friction-sensitive primer charge 11 is introduced directly into the recess 8, preferably by pressing and this charge rests on the constriction 9 and also fills a portion of the bore 10. The primer charge 11 is covered with a foil 12, for example of tin-plated lead, on the side facing away from the ignition charge 4. A percussion or striker member 13 is fixedly clamped on the same side of the pole piece 3 between the pole piece and the insulation 2 which rests on the housing 1. The percussion member 13 is associated with a holding element 14, in this case an annular collar, which can be sheared off, and is electrically conductively connected to the pole piece 3. The percussion member 13 has a tip 15 which, upon the effect of an impact, penetrates into the friction- and percussion-sensitive primer charge 11, during which process the holding element 14 is sheared off at the edge 16 of the pole piece 3.

The insulating element 5 is held in the illustrated position within the pole piece 3 by means of an annular contact disk 17, a spacer ring 18 and a flanged-over edge 19 of the housing 1, whereby simultaneously one of the contacts of the insulating element 5 is connected electrically conductively with the housing 1. A second primer charge 20 is placed on the ignition charge 4, preferably by pressing, to achieve an enhanced ignition effect. This second primer charge is covered by a foil 21, for example of tin-plated lead.

The electrically ignitable ignition charge 4 which is preferably pressed onto the insulating element 5 consists, for example, of lead trinitror esorcinate or a similarly ignition-sensitive component to which is added optionally about 2–4% by weight of graphite, carbon black, or the like to obtain electrical conductivity. The friction-sensitive primer charge 11 contains a friction agent, such as glass powder or calcium silicide. This primer charge 11 consists, for example, of 54% by weight of lead trinitroresorcinate or potassium chlorate, 10% by weight of tetrazene, 26% by weight of antimony sulfide, 4% by weight of calcium silicide, and 6% by weight of pulverized glass. The primer charge 20 consists, for example, of 30% by weight of lead trinitroresorcinate, 50% by weight of potassium perchlorate, and 20% by weight of calcium slicide. Which of the above-mentioned and numerous other possible compositions are utilized for the primer charge 4 and/or the ignition charges 11, 20 in each individual case, and whether the primer charge 20 can even be completely omitted, depends conventionally on the type of ignition energy available, the type of powder charge to be ignited, which is associated with the primer charge, the location of this powder charge, etc.

According to FIGS. 2*a* and 2*b*, the disk-shaped insulating element 5, which is mechanically solid and is shown in an even more enlarged view as compared to FIG. 1, and which is made, for example, of a synthetic resin or glass, but preferably of a ceramic material, is provided on its topside facing the primer charge 4, to be ignited electrically, with two contacts 22, 23 having the shape of an annular surface and having an annular gap 24 formed therebetween. According to DAS No. 2,020,016, the contacts 22, 23 are connected with each other by means of an ignition bridge 25. The primer charge 4, to be ignited electrically, then need not be electrically conductive. In contrast thereto, if a definite ignition gap is provided between the two contacts 22, 23 in place of the ignition bridge 25, i.e. if the electrical ignition is carried out according to the gap ignition priniciple, then the primer charge 4 covering the gap must be electrically conductive, as is conventional. The ignition bridge has preferably a width and a length of 50 – 250 $\mu$ and a thickness of 0.01 – 1.5 $\mu$. With the same thickness, the length of the ignition gap and the spacing of the contacts 22, 23 from each other are preferably 50 – 150 $\mu$.

The inner ring contact 23 is extended via a metallic coating 26 on the central axial recess 6 to the underside of the insulating element 5 and is fashioned at that location as a contact surface 27 provided for contacting the pole piece 3. FIG. 2*b* shows this structure in a sectional view along line II—II of FIG. 2*a*. The conductive coatings can be applied, for example, by vacuum vaporization, printing, or also by chemical methods. The ignition bridge 25 is produced preferably of tantalum or tantalum nitride, while the other coatings can consist, e.g., of nickel, palladium, palladium-gold, platinum-gold, etc. The layer thicknesses are shown greatly exaggerated herein, for reasons of providing a clear illustration. This metallic laminated element has an exactly defined electrical resistance, so that the flawless ignition at a predetermined ignition voltage is ensured. This element has no parts which are soldered or welded thereon.

The function of the combined igniter cap according to FIGS. 1, 2*a* and 2*b* is as follows: Upon mechanical ignition, after the striker element 13 has suddenly advanced, the tip 15 of this striker element penetrates the ignition charge 11. The latter is ignited and, in turn, ignites through the recess 6 of the insulating element 5, arranged in alignment with the bore 10, the primer charge 4. The latter then, in turn, initiates the other primer charge 20. When ignition is effected by electrical current, the contacting is effected via the striker element 13 which represents the positive pole, for example. From here, the electrical current flows via the pole piece 3, the contact surface 27, the coating 26, the inner ring contact 23, the ignition bridge and/or the ignition gap 25, the outer ring contact 22, the contact disk 17, and the spacer ring 18 to the housing 1. At the ignition bridge or the ignition gap 25, the primer charge 4 is ignited which, in turn, ignites the primer charge 20.

The combined igniter cap shown in FIG. 3 is different from the cap of FIG. 1 in that there is no striker element installed and no additional primer charge is applied to the primer charge 4. This additional charge can be omitted, for example, if a propellant charge of black powder associated therewith is to be ignited. The mechanical ignition is here effected by an outer striker pin, not shown, moved according to the path indicated by the arrow A. The electrical ignition likewise takes place with the aid of this striker pin, which latter is in electrically conductive contact with the electrically conductive cover 28, e.g. of tin-plated lead, of copper, or of brass, or can be brought into contact therewith. The cover 28 is connected in an electrically conductive manner with the pole piece 3 by way of the rim of this cover. Otherwise, the structure corresponds to the igniter cap shown in FIG. 1.

The combined igniter cap according to FIG. 4 has a percussion-sensitive igniter cap with a cup-shaped housing 29 and a primer charge 11 and anvil 30 arranged therein, the anvil resting on the bottom of the recess 8 of the pole piece 3. The housing 29 closes off the recess 8 toward the side facing away from the primer charge 4. The housing is electrically conductive and thus makes it possible to conduct current to the pole piece 3. The mechanical ignition takes place conventionally by compression of the igniter charge 11 between the bottom of the housing 29 and the anvil 30. Otherwise, the arrangement corresponds to the igniter cap shown in FIG. 1.

The mechanical sensitivity of the igniter cap of the present invention can be adjusted in a conventional manner by the shape of the tip of the striker pin and/or the anvil and by the composition of the friction- and impact-sensitive primer charge. Thus, a primer cap initiated by a striker element can be triggered by a percussion energy of about 0.3 cm·kp. To increase the impact resistance, the primer charges used herein are preferably compressed under a pressure of 1,000 – 3,000 kp./cm$^2$.

The electrical ignition conditions are provided by the design of the insulating element and the ignition bridge or ignition gap. Thus, an insulating element of, for example, a ceramic aluminum oxide material with a vaporized ignition bridge of tantalum can be designed with a narrowly limited internal resistance which can be, in the low-ohmic range, for example between 0.8 and 3Ω, or in the higher-ohmic range, for example between 20 and 50Ω. In the former case, i.e. with an internal resistance in the low-ohmic range, an igniter cap is obtained which is safe from leakage currents, whereas in the latter case a very sensitive igniter cap is obtained. If an ignition gap is provided in place of the ignition bridge, then the internal resistance is in a still higher range, for example between 100 and 500Ω, so that a highly sensitive electric primer is thus produced.

The combined igniter cap of this invention can be used in variegated fields of application due to its compact structure and the small dimensions. It is possible to attain a safe functioning of the entire component with, for example an outer diameter of 5 mm. and a height of 6 mm. Thus, the igniter cap is particularly suitable for smaller calibers.

While we have shown and described several embodiments in accordance with the present invention, it is understood that the same is not limited thereto but is susceptible of numerous changes and modifications as known to those skilled in the art and we therefore do not wish to be limited to the details shown and described herein but intend to cover all such changes and modifications as are encompassed by the scope of the appended claims.

We claim:

1. A combined igniter cap comprising an electrically conductive housing having a unitary one-piece pole piece arranged therein, a first primer charge arranged on a first side of said pole piece, said pole piece being provided with a recess and means providing a first communicating path through said pole piece between said recess and said first primer charge, a second ignition system being arranged in said recess and being ignitable from a second side of said pole piece which is disposed oppositely to said first side, and insulating element means formed of an electrically nonconductive material being disposed between said first side of said pole piece and said first primer charge, said insulating element means including first and second electrical contact members and an electrical ignition means formed therebetween, said electrical ignition means being arranged immediately adjacent a surface of said nonconductive material facing said first primer charge, said first contact member being electrically conductively connected with said pole piece and said second contact member being electrically conductively connected with said housing, said insulating element means further including second communicating path means for providing a communicating path between said first communicating path means and said first primer charge.

2. A combined igniter cap according to claim 1, wherein said first communicating path means includes at least one bore extending in the axial direction of said pole piece.

3. A combined igniter cap according to claim 2, wherein said second communicating path means includes at least one aperture extending in the axial direction of said insulating element means and being at least partially congruent with said at least one axially extending bore of said pole piece.

4. A combined igniter cap according to claim 3, wherein said at least one bore is centrally arranged in said pole piece, said recess of said pole piece and said at least one aperture of said insulating element means being arranged coaxially with said centrally arranged bore, said bore and said recess being connected by a conically-shaped constriction for concentrating an ignition jet of said second ignition system.

5. A combined igniter cap according to claim 4, wherein said at least one bore is a single centrally arranged bore and said at least one aperture in said insulating element means is a single aperture, said conically-shaped constriction narrowing in the direction of said single bore.

6. A combined igniter cap according to claim 1, wherein said second ignition system includes a striker primer cap means and a striker-sensitive ignition charge arranged in said recess of said pole piece.

7. A combined igniter cap according to claim 6, wherein said striker-sensitive ignition charge is at least partially arranged in said first communicating path means and is directly pressed into said recess and said first communicating path means.

8. A combined igniter cap according to claim 6, wherein said striker primer cap means includes an electrically conductive striker element and a holding element for said striker element, said holding element being electrically conductively connected with said pole piece.

9. A combined igniter cap according to claim 8, wherein said holding element is an annular collar surrounding said striker element and arranged to be sheared off when a force is applied to said striker element for causing said striker element to strike said striker-sensitive ignition charge.

10. A combined igniter cap according to claim 8, further comprising electrical insulation disposed between said pole piece and said housing, said holding element being clamped between said pole piece and said insulation resting on said housing.

11. A combined igniter cap according to claim 1, wherein said second ignition system includes a percussion-sensitive primer cap means having a cup-shaped housing and an anvil provided therein, said anvil resting in said recess of said pole piece.

12. A combined igniter cap according to claim 11, wherein said percussion-sensitive primer cap means includes a percussion-sensitive ignition charge arranged within said cup-shaped housing.

13. A combined igniter cap according to claim 1, wherein said second ignition system is a nonelectrical ignition system.

14. A combined igniter cap according to claim 13, wherein said nonelectrical ignition system includes a flame-sensitive ignition charge arranged in said recess of said pole piece.

15. A combined igniter cap according to claim 1, wherein said electrical ignition means is one of an ignition bridge and an ignition gap.

16. A combined igniter cap according to claim 1, wherein said pole piece is provided with a depression at said first side thereof, said insulating element means being arranged within said depression.

17. A combined igniter cap according to claim 4, wherein said second ignition system includes a striker primer cap means and a striker-sensitive ignition charge arranged in said recess of said pole piece.

18. A combined igniter cap according to claim 17, wherein said striker primer cap means includes an electrically conductive striker element and a holding element for said striker element, said holding element being electrically conductively connected with said pole piece.

19. A combined igniter cap according to claim 18, wherein said holding element is an annular collar surrounding said striker element and arranged to be sheared off when a force is applied to said striker element for causing said striker element to strike said striker-sensitive ignition charge.

20. A combined igniter cap according to claim 18, further comprising electrical insulation disposed between said pole piece and said housing, said holding element being clamped between said pole piece and said insulation resting on said housing.

21. A combined igniter cap according to claim 4, wherein said second ignition system includes a percussion-sensitive primer cap means having a cup-shaped housing and an anvil provided therein, said anvil resting in said recess of said pole piece.

22. A combined igniter cap according to claim 4, wherein said second ignition system is a nonelectrical ignition system.

23. A combined igniter cap according to claim 1, further comprising electrical insulation means contacting said pole piece and said housing for insulating said pole piece from said housing.

24. A combined igniter cap according to claim 23, wherein said insulating element means includes an annular element having portions of said first and second electrical contact members disposed on an end surface thereof facing said first primer charge, said electrical ignition means being formed therebetween.

25. A combined igniter cap according to claim 24, wherein said electrical ignition means is one of an ignition bridge and an ignition gap.

* * * * *